US007654028B1

(12) United States Patent
Grover

(10) Patent No.: US 7,654,028 B1
(45) Date of Patent: Feb. 2, 2010

(54) HIGH-STRENGTH SLING SWIVEL

(75) Inventor: Robert L. Grover, Gladstone, OR (US)

(73) Assignee: Grovtec U S, Inc., Clackamas, OR (US)

( * ) Notice: Subject to any disclaimer, the term of this patent is extended or adjusted under 35 U.S.C. 154(b) by 0 days.

(21) Appl. No.: 12/013,393

(22) Filed: Jan. 11, 2008

Related U.S. Application Data

(60) Provisional application No. 60/880,298, filed on Jan. 11, 2007.

(51) Int. Cl.
*F41C 23/02* (2006.01)
*F41C 33/00* (2006.01)

(52) U.S. Cl. ..... 42/85; 24/2.5; 224/150

(58) Field of Classification Search ..... 42/85; 24/2.5; 224/150
See application file for complete search history.

(56) References Cited

U.S. PATENT DOCUMENTS

| | | | | |
|---|---|---|---|---|
| 2,639,480 | A * | 5/1953 | Magid | 24/374 |
| 3,704,537 | A | 12/1972 | McKinzie | |
| 4,209,157 | A * | 6/1980 | Edmisten | 248/691 |
| 4,454,675 | A | 6/1984 | Ives | |
| 4,505,012 | A | 3/1985 | Johnson | |
| 4,835,823 | A | 6/1989 | Contat | |
| 4,841,658 | A * | 6/1989 | Katsenes | 42/85 |
| 4,924,615 | A * | 5/1990 | Ives | 42/85 |
| 5,067,267 | A | 11/1991 | Ives | |
| 5,517,839 | A * | 5/1996 | Parsons | 70/456 R |
| 6,178,600 | B1 | 1/2001 | French | |
| D444,201 | S | 6/2001 | Norris, Sr. | |
| 6,354,034 | B1 | 3/2002 | Norris, Sr. | |
| 6,536,154 | B1 | 3/2003 | Norris | |
| 2003/0046853 | A1 * | 3/2003 | Norris | 42/85 |
| 2003/0234266 | A1 * | 12/2003 | Thompson | 224/150 |

* cited by examiner

*Primary Examiner*—Bret Hayes
(74) *Attorney, Agent, or Firm*—Stoel Rives LLP

(57) ABSTRACT

A detachable sling swivel capable of withstanding substantial pull forces includes a loop joined to a mounting body that detachably engages a sling swivel stud or other similar mounting device. At least a portion of the loop may have a substantially "T" shaped cross section, or T-beam construction. Various locking gate mechanisms are disclosed, including one having a gate configured to engage the T-beam construction of the loop for improved security and strength.

21 Claims, 3 Drawing Sheets

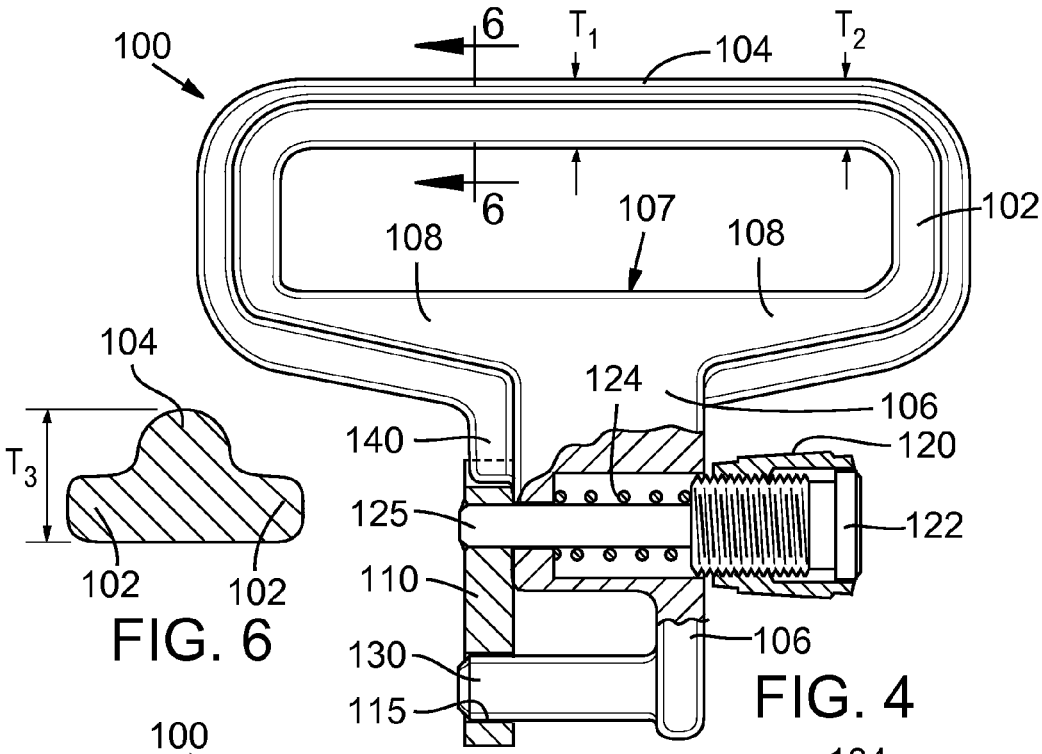
FIG. 6
FIG. 4
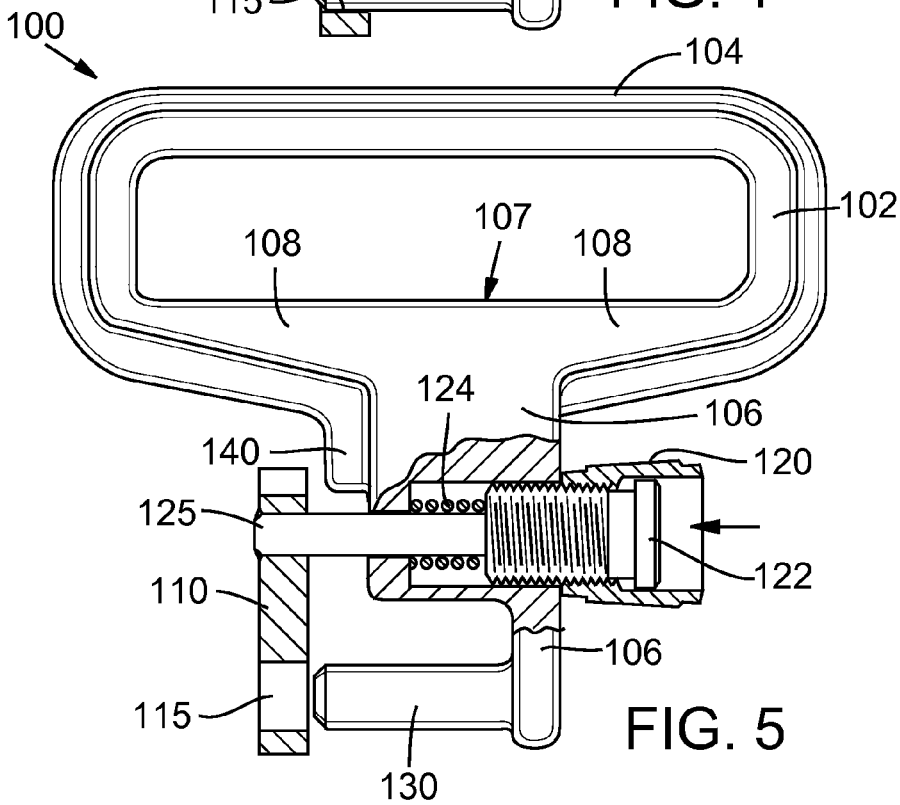
FIG. 5

HIGH-STRENGTH SLING SWIVEL

RELATED APPLICATION

This application claims the benefit under 35 U.S.C. § 119 (e) of U.S. Provisional Patent Application No. 60/880,298, filed Jan. 11, 2007, which is incorporated herein by reference.

TECHNICAL FIELD

The technical field of the disclosure relates to sling strap connecting devices and more particularly to sling strap swivels of the kind used with firearms.

BACKGROUND

Slings are often included with or used as an accessory to a rifle, shotgun, or any other style of firearm. Generally the sling is attached at one end on or near the forearm or barrel and at the other end to the butt portion of the stock. Each end of the sling attaches to a sling loop that in turn attaches to the firearm with a sling swivel. The sling loop may rotate with respect to sling swivel and to the stock so that the sling loop may remain properly aligned to the direction the sling is pulled.

Slings are a valuable tool for shooters of all types. Among other functions, a sling may be used to tote a gun over a shooter's shoulder. Further, the sling may stabilize the gun as the shooter takes aim. The sling may also be used to carry or drag the shooter and/or their equipment should the shooter be injured or another emergency arise for example in combat. Because sling swivels are used with firearms, the sling swivels should be sturdy enough so that the sling swivel does not break, detach, or otherwise allow the firearm to become disengaged from the sling inadvertently. Nevertheless, it may be desirable that the sling swivel be quickly detachable, so that the sling may be quickly removed from the firearm.

Numerous approaches exist to provide a detachable sling swivel for a firearm. For example, U.S. Pat. No. 2,480,662 to McKinzie describes a sling swivel that may be inserted into and detachably secured to a base. The sling swivel may be removed or detached from the base by operation of a plunger disposed within the body of the sling swivel. As the user merely operates the plunger to remove or detach the sling swivel from its base, the removal or detachment may be quickly completed without tools. However, the plunger may potentially be exposed to inadvertent operation and the sling swivel may detach as a result.

U.S. Pat. Nos. 4,454,675 and 5,067,267 to Ives both disclose a quick-detachable sling swivel. Each sling swivel includes a gate or retainer that is shiftable between and open and closed position by operating a spring-biased plunger. The sling swivel may be attached to or detached from a mounting base while the gate or retainer is in the open position and secured to the mounting base with the gate or retainer in the closed position. The spring-biased plunger may include a locking element to prevent the inadvertent operation thereof and resulting detachment of the sling.

U.S. Pat. No. 6,354,034 to Norris discloses a quick-detachable sling swivel comprising a body and a shift/swing gate mounted on the body by way of an elongated plunger. The gate is adjustable between open and closed positions relative to the body to enable the sling swivel to be alternately mounted, demounted, and secured relative to a sling swivel base. The sling loop of the Norris '034 swivel has a pair of opposed substantially parallel side members and a substantially rectangular cross section, The body and the sling loop are integrally formed of injection molded metal. The Norris '034 patent asserts that this sling swivel may be capable of withstanding at least 500 pounds of pull force.

The present inventors have identified a need for an improved sling swivel.

BRIEF DESCRIPTION OF THE DRAWINGS

FIG. 4 is a front elevation view of the sling swivel of an embodiment including a cross section of a plunger when the gate is in a locked position;

FIG. 5 is the sling swivel of FIG. 4 when the plunger is translated along a plunger axis and the gate is unlocked;

FIG. 6 is an enlarged cross sectional view of the loop of the sling swivel of an embodiment taken along lines 6-6 of FIG. 4;

DETAILED DESCRIPTION OF PREFERRED EMBODIMENTS

An embodiment is a detachable sling swivel capable of withstanding substantial pull forces, and in particular the pull force required by military standards. The sling swivel of an embodiment includes a loop to which a sling (or sling strap) may be attached and a mounting body located opposite the loop. The mounting body includes a mounting pin to engage a sling swivel stud or other similar mounting device. The sling swivel stud or other similar mounting device may be attached to a firearm or other item to which a sling may be attached. The mounting body further includes a plunger that defines a plunger axis. The plunger is movable axially between a first and a second position with respect to the mounting body. A gate is associated with the mounting body through the plunger and may be locked or unlocked when the plunger is in the first or second position respectively. When the gate is unlocked, the gate may be rotated about the plunger axis so that the mounting pin may be accessible to the sling swivel stud for removable attachment and detachment. When the gate is locked, the gate engages the mounting pin to substantially lock the sling swivel to the sling swivel stud and to substantially prevent the gate from rotating. In an embodiment, the loop and mounting body are an integral member. Further, at least a portion of the loop may have an approximately "T" shaped cross section.

Figure 1:
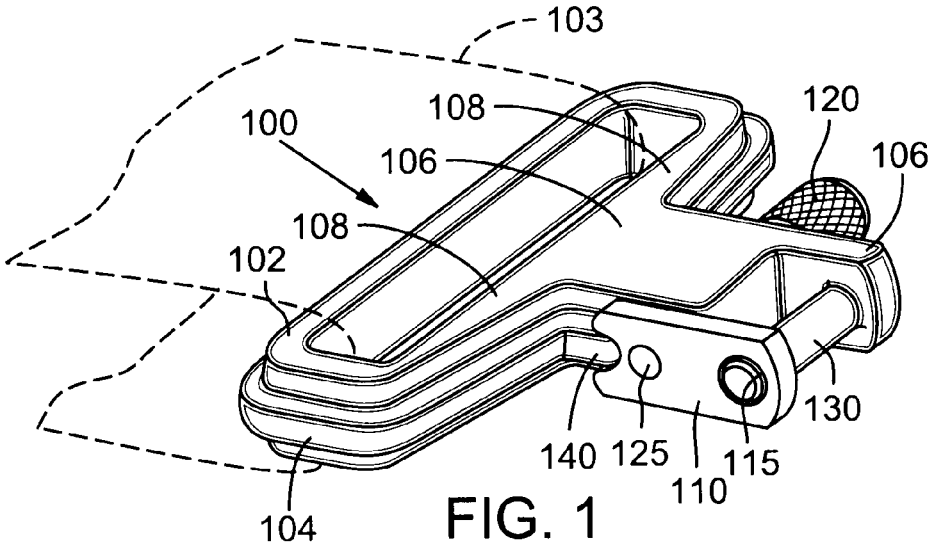
FIG. 1 is a pictorial side three-quarter view of the sling swivel of an embodiment.

FIG. 1 is a pictorial side three-quarter view of the sling swivel 100 of an embodiment. The sling swivel 100 of an embodiment includes a loop 102 to which a sling or sling strap 103 may be attached and a mounting body 106. The loop 102 may further include a ridge 104 such that including the ridge 104, the loop 102 may have an approximately "T" shaped cross section. The mounting body 106 includes a mounting pin 130 to engage a sling swivel stud attached to a firearm (not illustrated) or other similar mounting device that includes a suitable bore to receive mounting pin 130. The sling swivel stud or similar mounting device may alternately be attached to or included with any item to which it would be useful to attach the sling strap 103.

Figure 2:
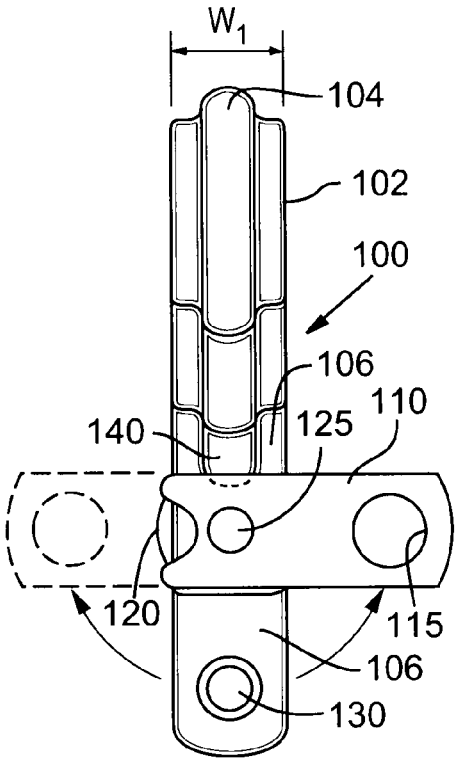
FIG. 2 is a side elevation view of the sling swivel of an embodiment with a gate in an open and rotatable position.
Figure 3:
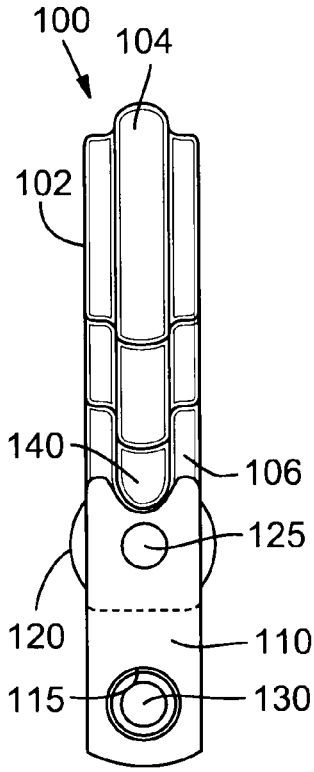
FIG. 3 is the sling swivel of FIG. 2 with the gate in a closed position and engaging a mounting pin.

In an embodiment, the sling swivel 100 may be detachable. For example, the sling swivel 100 may be detached without using tools. In an embodiment, translating plunger 125 along the plunger axis between the first and second position may translate the gate 110 attached thereto so that it couples to or is decoupled from the mounting pin 130 when locked and unlocked respectively. If unlocked and decoupled from the mounting pin, and as illustrated by FIG. 2, the gate 110 may rotate about the plunger axis to enable mounting pin 130 to detachably engage or disengage the sling swivel stud other similar mounting device including a suitable bore to receive mounting pin 130. Once the mounting pin 130 has been inserted through the bore of the sling swivel stud or other similar mounting device, the gate 110 may be rotated to align its hole 115 with the mounting pin 130. The plunger 125 may then translate the gate 110 such that the hole 115 engages the mounting pin 130 to lock the gate as illustrated by FIG. 3.

FIGS. 4 and 5 illustrate that in an embodiment, the plunger 125 may be spring biased toward the first position. More specifically, the bore or cavity within the mounting body 106 that includes the plunger 125 may further include a spring 124 that biases the plunger 125 toward the first position to maintain the gate 110 in the locked position (e.g., the hole 115 engaging the mounting pin 130). For example, as oriented in FIG. 4, the spring 124 pushes the plunger 125 to the right so that the gate 110 attached thereto is pulled similarly to the right to substantially prevent the gate 110 from disengaging the mounting pin 130. FIG. 5 illustrates that when the plunger 125 is depressed to the second position and the gate 110 is unlocked, the spring 124 compresses.

Figure 7:
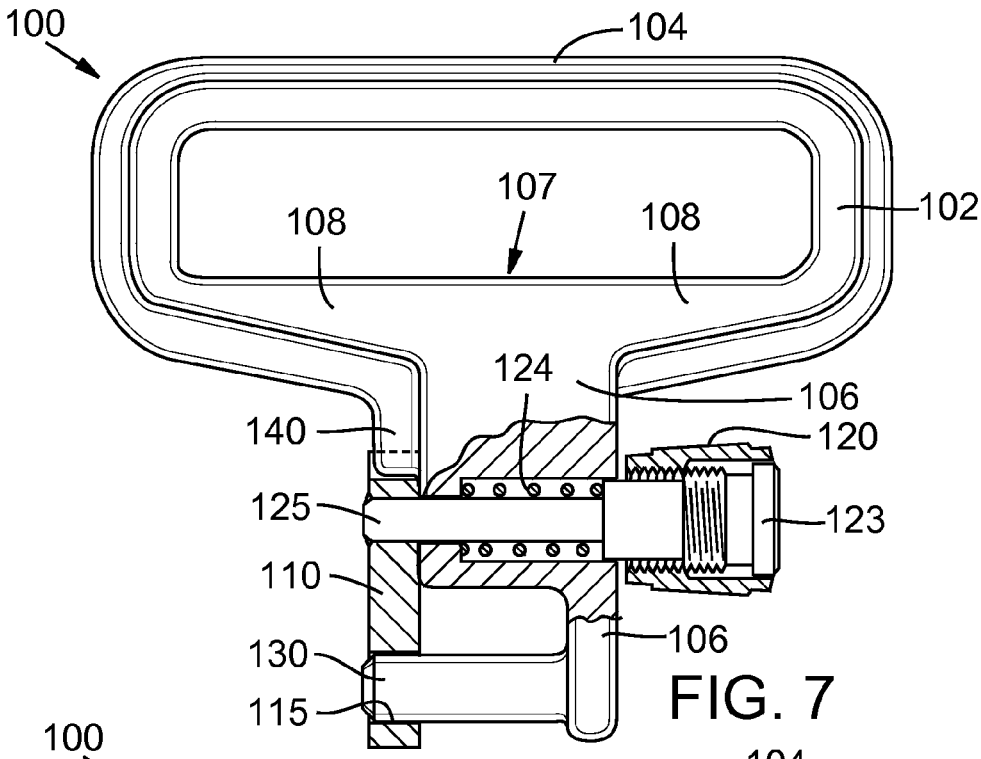
FIG. 7 is a front elevation view of the sling swivel of an alternate embodiment including a cross section of a plunger when the gate is in a locked position.
Figure 8:
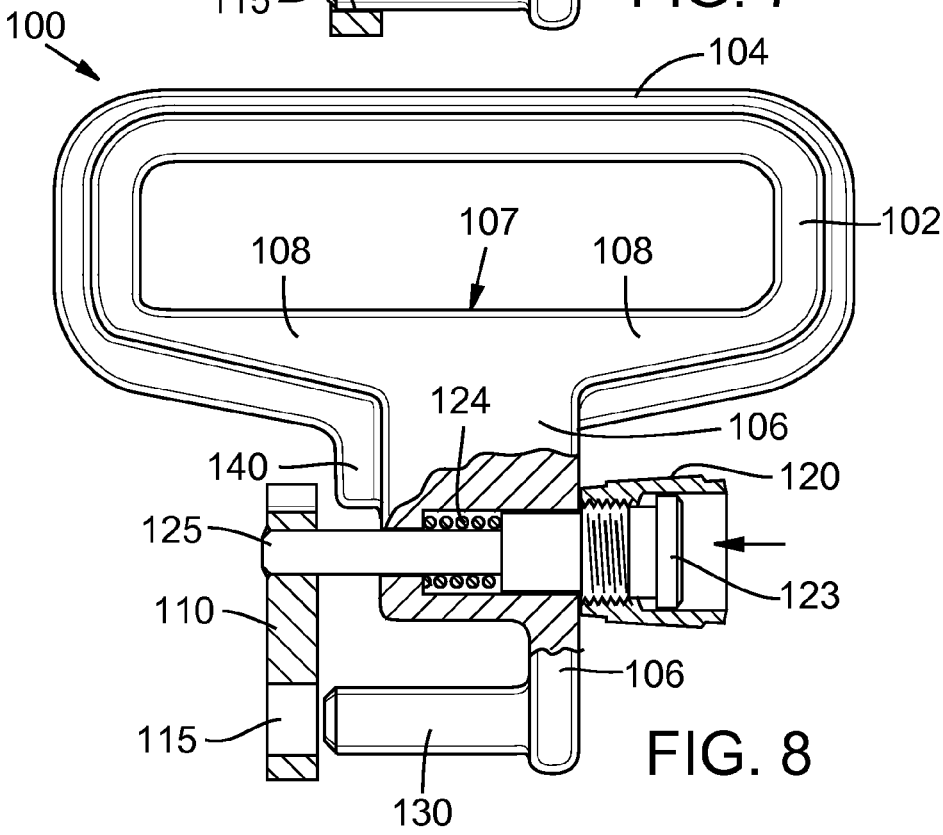
FIG. 8 is the sling swivel of FIG. 7 when the plunger is translated along a plunger axis and the gate is unlocked

Further, the plunger 125 may include a locking mechanism 120 having features substantially as described by the '675 patent to Ives. For example, the end of the plunger 125 opposite the gate 110, or plunger shoulder 122, may be threaded or otherwise configured to accept locking mechanism 120 that may alternatively allow or prevent movement of the plunger 125 along the plunger axis to lock and unlock the gate 110. For example, the locking mechanism 120 may also be threaded so that it may engage the threads of the plunger shoulder 122. As illustrated by FIG. 4, the locking mechanism 120 may be tightened against the mounting body 106 when the plunger 125 and gate 110 are in the locked position to substantially prevent the actuation of the plunger 125 to unlock the gate 110 and the loosening of the locking mechanism 120. FIG. 5 illustrates that the locking mechanism may be unscrewed or loosened from the plunger shoulder 122 to allow the actuation of plunger 125 to translate the gate 110 to its unlocked position. In such a manner, the locking mechanism 120 may not be substantially prone to inadvertent operation Alternatively, as illustrated by FIGS. 7 and 8, the plunger 125 may include a locking mechanism 120 having features substantially as described by the '267 patent to Ives. The plunger shoulder 123 is not completely threaded along its axial length. Accordingly, the internal threads of the locking mechanism 120 may not engage the threads on the plunger shoulder 123 when the gate 110 is in the locked position and the locking mechanism 120 is seated against the mounting body 106. This allows the locking mechanism 120 to substantially freely spin without engaging the threads of the plunger shoulder 123 in the absence of, for example, a user affirmatively pulling the locking mechanism 120 away from the mounting body 106. It is to be understood that alternative embodiments may include other mechanical locking mechanisms 120 that lock the gate 110 in the closed position with respect to mounting pin 130 provided the locking mechanism 120 is capable of withstanding the pull forces required of the sling swivel 100.

The sling swivel 100 of an embodiment is capable of withstanding substantial pulling forces (e.g., from the sling strap 103 attached thereto). In particular, the sling swivel 100 of an embodiment is capable of withstanding at least 500 pounds of pulling force to comply with military standards. A variety of features may contribute to the strength of the sling swivel 100, the first of which may be the approximate "T" shaped cross section of the loop 102 of the sling swivel 100. Said alternatively, the loop 102 may have a T-beam construction for which W1 of FIG. 2 is the flange width and T1-T3 of FIGS. 4 and 6 represent tee depths at various locations on the bar end. In an embodiment, T1-T3 are approximately the same. In an alternate embodiment, T1 at substantially the middle of the loop 102 may be larger than T2 laterally displaced from T1. The loop end 102 may include a ridge 104 (e.g., the stem of the T-beam) or bead extending around substantially the middle of the outer peripheral surface of loop 102. In an embodiment, and as illustrated by FIG. 6, the ridge 104 approximately doubles the thickness T3 of the loop end 102 (e.g., the distance from to the inside of the loop 102 to the outside of loop 102, or tee depth). Further, and as illustrated by FIGS. 2, 3, and 6, the ridge 104 may span approximately between 25% and 50% of the width of the outer edge of the loop end 102 W1. In other words, the stem width of the t-beam is approximately between 25% and 50% of the flange width W1. In an embodiment, and as will be described more fully below, the ridge 104 may extend partially along the mounting body 106 adjacent to the gate 110 to form an additional mechanism by which the gate 110 may be maintained in the locked position.

The approximately "T" shaped cross section, or t-beam construction, of the loop 102 of an embodiment may increase the pulling force the sling swivel 100 may withstand before at least the loop 102 deforms and/or fails. In an embodiment, the sling swivel 100 may withstand the pulling force required by military standard while reducing the weight of the sling swivel 100 and materials used. For example, as the sling strap 103 pulls on the loop 102, the loop 102 will be subjected to axial force, shear, and a bending moment as is known in the mechanical art. In general, the outside edge of the loop 102 opposite the mounting body 106 may experience tension while the inside edge of the loop 102 may experience compression. The ridge 104 of an embodiment included along the peripheral surface the loop 102 may improve the loop 102 pulling force strength by increasing the tension the loop end 102 may resist along its outer edge.

Similarly, the portion of the loop 102 proximate the mounting body 106 may not have a uniform cross section if viewed from different lateral distances from the mounting body 106. For example, FIGS. 1, 4, 5, 7, and 8 illustrate that the loop 102 may include taper 108 such that the loop 102 may be thicker (e.g., distance from the inside of the loop 102 to the outside of the loop 102 as illustrated by T1-T3) at the region where the loop 102 and the mounting body 106 join (e.g., at neck 107) compared to other portions of the loop 102. In an embodiment, the loop 102 thickness at taper 108 is substantially a linearly decreasing taper from its intersection with the mounting body 106 (e.g., at neck 107) extending laterally outwardly. In an embodiment, the ridge 104 is approximately the same size along the outer surface of loop 102, including the portion of the ridge 104 adjacent to the taper 108. In an embodiment, the taper 108 portion of the loop 102 may increase the pull strength of the sling swivel 100 compared to a sling swivel 100 without taper 108.

FIGS. 1 and 3 illustrate that in a further embodiment, the ridge 104 may extend down a portion of the mounting body 106 adjacent to the gate 110 to form a finger 140. In an embodiment, the gate 110 may include a notch to align with and engage the finger 140 when the gate 110 is in the locked position. Accordingly, in addition to engaging the mounting pin 130 with hole 115, the gate 110 notch may further engage the finger 140 to increase the rotational strength of the gate 110 about the rotational axis of the plunger 125 when the gate is in the locked position. In an embodiment, the end of finger 140 is preferably radiused and may have has a substantially semicircular profile as illustrated by FIGS. 2 and 3. In an embodiment, the notch of gate 110 is also preferably radiused and may have a substantially semicircular profile to complement the end of finger 140.

In an embodiment, the loop 102, ridge 104, tapers 108, mounting body 106, mounting pin 130, and finger 140 are integrally formed of metal injection molding (MIM) or integrally otherwise. In particular, the mounting pin 130 is integrally formed of MIM with the mounting body 106. The integration of the sections of sling swivel 100 may further contribute to the increased strength of the sling swivel 100 of an embodiment.

Accordingly, the sling swivel according to embodiments may include one or more of several features that may increase the pulling force that sling swivel 100 withstands. The "T" shaped cross section, or t-beam construction, of the loop 102 including ridge 104 may resist deformation and failure. The tapers 108 further aid the loop 102 to resist deformation and failure. In addition to the locking member 120, the finger 140 may help the gate 110 remain locked as it may increase the rotational locking strength of the gate. Individually and in combination, the disclosed features of an embodiment may increase the pull strength of sling swivel 100.

Throughout the specification, reference to "one embodiment," "an embodiment," or "some embodiments" means that a particular described feature, structure, or characteristic is included in at least one embodiment. Thus appearances of the phrases "in one embodiment," "in an embodiment," or "in some embodiments" in various places throughout this specification are not necessarily all referring to the same embodiment. Furthermore, the described features, structures, characteristics, and methods may be combined in any suitable manner in one or more embodiments. Those skilled in the art will recognize that the various embodiments can be practiced without one or more of the specific details or with other methods, components, materials, etc. In other instances, well-known structures, materials, or operations are not shown or not described in detail to avoid obscuring aspects of the embodiments.

While certain features of an embodiment yield certain advantages, the arrangement, dimensions, combination of the various features, and the resulting overall appearance of the sling swivel 100 may be tailored to satisfy aesthetic and ornamental needs. Further, It will be obvious to those having skill in the art that many changes may be made to the details of the above-described embodiments without departing from the underlying principles of the invention. The scope of the present invention should, therefore, be determined only by the following claims.

The invention claimed is:

1. A sling swivel, comprising:

a loop sized to receive a sling strap, the loop including a ridge along its outer periphery so that the loop has an approximately T-shaped cross section;

a mounting body joined to the loop, the mounting body having a mounting pin;

a plunger disposed in the mounting body, the plunger defining a plunger axis, the plunger movable axially along the plunger axis between a first position and a second position; and a gate attached to the plunger, the gate to detachably engage the mounting pin when the plunger is in the first position and to disengage from the mounting pin when the plunger is in the second position.

2. The sling swivel of claim 1, the gate to lock when the plunger is in the first position and unlock when the plunger is in the second position.

3. The sling swivel of claim 2, the gate comprising a hole to detachably engage the mounting pin when the gate is locked.

4. The sling swivel of claim 1, the ridge to extend along a portion of the mounting body adjacent to the gate to form a finger.

5. The sling swivel of claim 4, the gate comprising a notch to detachably engage the finger when the gate is locked.

6. The sling swivel of claim 5, the finger and the mounting pin to detachably engage the notch and hole of the gate respectively to substantially prevent the gate from rotating when locked.

7. The sling swivel of claim 1, the mounting pin to detachably engage a sling swivel stud.

8. The sling swivel of claim 1 wherein the loop and the mounting body are integrally formed.

9. The sling swivel of claim 8 wherein the loop and the mounting body are integrally formed by metal injection molding.

10. The sling swivel of claim 1, the plunger comprising a locking mechanism to substantially prevent actuation of the plunger when the gate is locked.

11. The sling swivel of claim 1, the sling swivel to withstand at least 500 pounds of pull force.

12. A quick-detachable sling swivel comprising:

a loop sized to receive a sling strap, the loop having a T-beam construction with a T-beam stem extending around the periphery of the loop;

a mounting body joined to the loop, the mounting body including a mounting pin integrally formed therewith;

a plunger disposed in the mounting body, the plunger defining a plunger axis, the plunger movable axially along the plunger axis; and a gate attached to the plunger, the gate to have a locked position and an unlocked position based on the position of the plunger along the plunger axis, the gate to rotate away from and allow access to the mounting pin in the unlocked position and to align with and engage the mounting pin in the locked position.

13. The quick-detachable sling swivel of claim 12, the T-beam stem to extend along a portion of the mounting body adjacent to the gate to form a finger.

14. The sling swivel of claim 13, the gate comprising a notch to detachably engage the finger and a hole to detachably engage the mounting pin to substantially prevent the gate from rotating in the locked position.

15. The sling swivel of claim 14, the finger comprising a substantially semicircular end, the notch to have a substantially semicircular shape complementary to the semicircular end of the finger.

16. The sling swivel of claim 12, a portion of the loop adjoining the mounting body to have a tapered thickness.

17. The sling swivel of claim 16, the portion of the loop adjoining the mounting body to have a decreasingly tapered thickness as the loop extends laterally from the mounting body.

18. In combination, a sling swivel connecting a sling strap to a sling swivel stud, the sling swivel comprising:

a loop including a ridge along and substantially centered on its outer surface, the loop having a substantially T-shaped cross section;

a mounting body joined to the loop, the mounting body including a mounting pin receivable by the sling swivel stud;

a spring-biased plunger disposed in the mounting body, the spring-biased plunger defining a plunger axis, the spring-biased plunger movable axially along the plunger axis; and a gate attached to the spring-biased plunger, the gate to have a locked position and an unlocked position based on the position of the spring-biased plunger along the plunger axis, the gate to rotate away from the mounting pin in the unlocked position to allow the sling swivel stud to disengage from the mounting pin, and in the locked position to align with and detachably engage the mounting pin to detachably secure the sling swivel to the sling swivel stud.

19. The combination of claim 18, the ridge to extend along a portion of the mounting body adjacent to the gate to form a finger.

20. The combination of claim 19, the gate comprising a notch to detachably engage the finger and a hole to detachably engage the mounting pin to substantially prevent the gate from rotating in the locked position, wherein the finger includes a radiused end and the notch to have a radius complementary to the radiused end of the finger.

21. The combination of claim 18, a portion of the loop adjoining the mounting body to have a decreasingly tapered thickness as the loop extends laterally from the mounting body.

* * * * *